US007392802B2

(12) United States Patent
Yeh

(10) Patent No.: US 7,392,802 B2
(45) Date of Patent: Jul. 1, 2008

(54) PAINTBALL GUN LOADING DEVICE

(75) Inventor: Hsin-Cheng Yeh, Tainan Hsien (TW)

(73) Assignee: Sunwold Industrial Co., Ltd., Tainan Hsien (TW)

( * ) Notice: Subject to any disclaimer, the term of this patent is extended or adjusted under 35 U.S.C. 154(b) by 148 days.

(21) Appl. No.: 11/535,477

(22) Filed: Sep. 26, 2006

(65) Prior Publication Data

US 2008/0092867 A1 Apr. 24, 2008

(51) Int. Cl.
*F41F 1/00* (2006.01)

(52) U.S. Cl. ..... 124/51.1; 124/82

(58) Field of Classification Search ..... 124/49, 124/51.1, 82

See application file for complete search history.

(56) References Cited

U.S. PATENT DOCUMENTS 6,282,999 B1 * 9/2001 Hite et al. ..... 81/445
6,284,973 B1 * 9/2001 Daoud ..... 174/654
6,591,824 B2 * 7/2003 Hatcher ..... 124/56
7,178,515 B2 * 2/2007 Carpenter et al. ..... 124/49
7,252,080 B2 * 8/2007 Yeh ..... 124/82
2002/0059928 A1 * 5/2002 Ferrara et al. ..... 124/49
2002/0129804 A1 * 9/2002 Sullivan et al. ..... 124/49
2003/0213481 A1 * 11/2003 Bell ..... 124/56
2005/0284456 A1 * 12/2005 Chipley ..... 124/51.1
2006/0032488 A1 * 2/2006 Telford ..... 124/82

* cited by examiner

*Primary Examiner*—Troy Chambers
(74) *Attorney, Agent, or Firm*—WPAT, P.C.

(57) ABSTRACT

A paintball gun loading device includes a main body, a tightening ring and a retaining ring. The main body has a first clamping section and a second clamping section. The first clamping section comprises a first inclined surface and the second clamping section comprises a second inclined surface. The tightening ring comprises a third inclined surface and a fourth inclined surface. The third inclined surface is engaged with the first inclined surface of the first clamping section, while the fourth inclined surface corresponds to a fifth inclined surface of the retaining ring. The retaining ring further comprises a sixth inclined surface corresponding to the second inclined surface of the second clamping section. This tightness of the retaining ring does not apply to the main body direct. There is no deformation concern of the main body.

9 Claims, 7 Drawing Sheets

PAINTBALL GUN LOADING DEVICE

BACKGROUND OF THE INVENTION

1. Field of the Invention

The present invention relates to a paintball gun loading device, in particular to one secured on a paintball gun to avoid deformation of a main body and looseness of a funnel.

2. Description of the Prior Art

There are many paintball gun loading devices on the market. Most conventional paintball guns comprise an opening on the top to secure a loading device thereat. Conventional loading devices may be in three categories:

1. A main body A of a loading device, as shown in FIG. 5, comprises a number of longitudinal slots A1 and a retaining ring A2 to secure a funnel. The opening of the retaining ring A2 has a tightening section A3 provided with a bolt A4 to tighten the slots A1 so as to secure the funnel. This design requires the user to screw the bolt A4 to tighten the funnel, which requires more assembling work force.

2. A main body B of a loading device, as shown in FIG. 6, comprises a number of longitudinal slots B1 and a retaining ring B2 on the main body B. By rotating the retaining ring B2, the longitudinal slots B1 are tightened to secure a funnel thereon, however, this design requires turning the retaining ring B2 to adjust the tightness, which consumes manpower.

3. A main body C of a loading device, as shown in FIG. 7, comprises a number of slots C1 longitudinally disposed around the main body C, which is tightened by a retaining ring C2. The retaining ring C2 is provided with a quick-release rod C3 and a nut C4. By turning the nut C4 to thread the quick-released rod C3 to adjust the slots C1 so as to tighten a funnel C5. However, this design of using the retaining ring C2 to tighten the main body C may cause deformation of the main body C after a period of time, and the funnel C5 may be not easy to tighten again.

SUMMARY OF THE INVENTION

It is the primary objective of the present invention to provide a paintball gun loading device, which uses a number of inclined surfaces provided on a main body, a tightening ring and a retaining ring to engage with each other. The main body of the loading device is free from compression of any improper force.

It is another objective of the present invention to provide a paintball gun loading device, which is able to mount and dismount in an easy and fast way.

It is a further objective of the present invention to provide a paintball gun loading device, which saves labor hour and is cost-effective.

According to the present invention, there is provided a paintball gun loading device, comprising:

a main body, said main body having a number of slots disposed longitudinally along said main body, a first clamping section and a second clamping section, said first clamping section comprising a first inclined surface and said second clamping section comprising a second inclined surface;

a tightening ring, said tightening ring being sleeved onto said main body and comprising a third inclined surface and a fourth inclined surface, said third inclined surface being engaged with said first inclined surface of said first clamping section; and a retaining ring, said retaining ring being sleeved onto said main body and comprising a fifth inclined surface and a sixth inclined surface, said retaining ring being provided with a quick-release rod and a nut, said fifth inclined surface being engaged with said fourth inclined surface of said tightening ring, said sixth inclined surface being engaged with said second inclined surface of said second clamping section.

Preferably said tightening ring is sleeved onto said first clamping section of said main body.

Preferably said retaining ring is sleeved onto said second clamping section of said main body.

Preferably said first inclined surface is formed on a top edge of said first clamping section.

Preferably said second inclined surface is formed on a bottom edge of said second clamping section.

Preferably said third inclined surface is formed on a top inner edge of said tightening ring.

Preferably said fourth inclined surface is formed on a bottom outer edge of said tightening ring.

Preferably said fifth inclined surface is formed on a top inner edge of the retaining ring.

Preferably said sixth inclined surface is formed on a bottom inner edge of the retaining ring.

DETAILED DESCRIPTION OF THE PREFERRED EMBODIMENT

Figure 1:
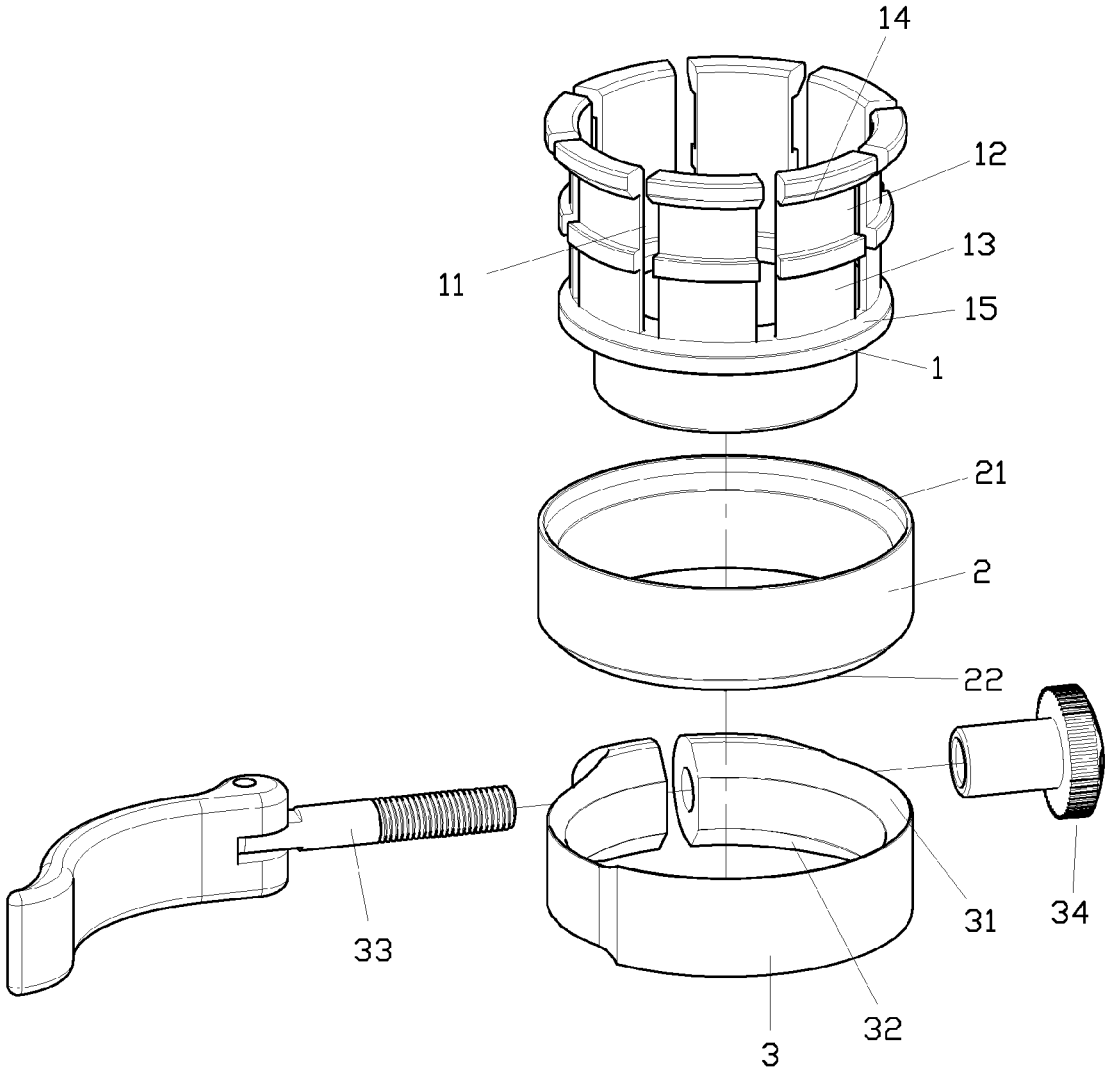
FIG. 1 is an exploded view of the present invention.
Figure 2:
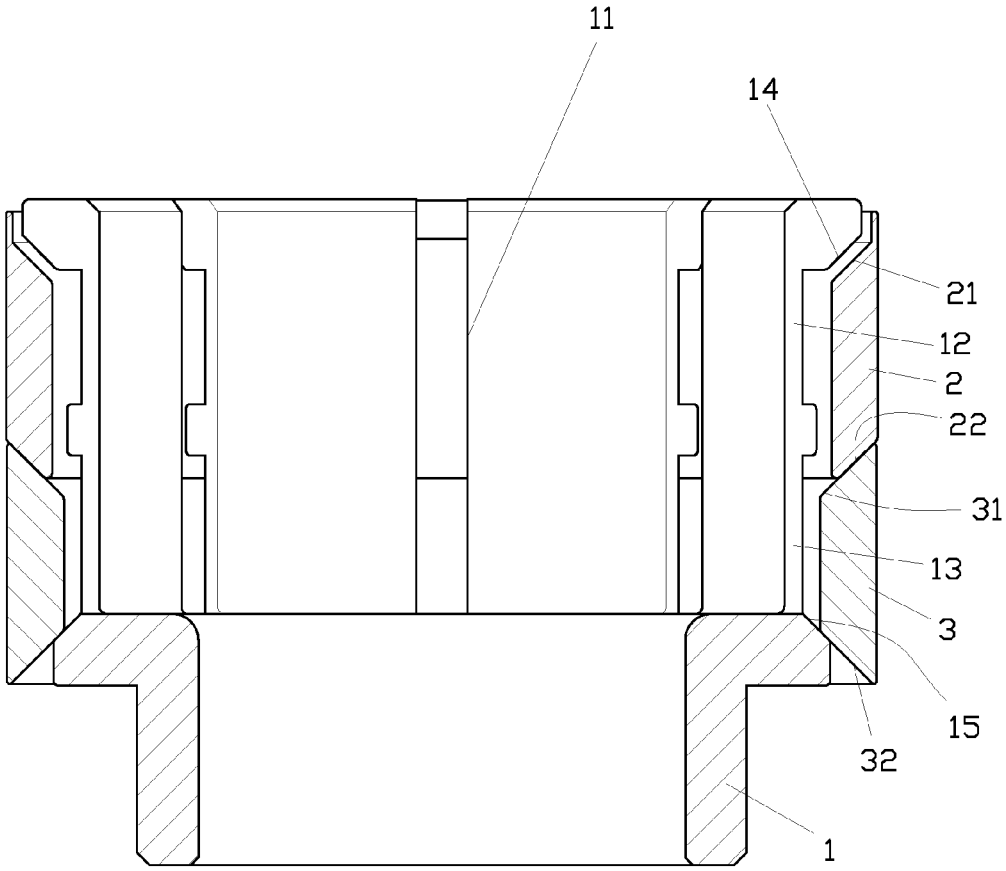
FIG. 2 is a cross-sectional view of the present invention.

As shown in FIGS. 1 and 2, a preferred embodiment of the present invention comprises a main body 1, a tightening ring 2 and a retaining ring 3.

The main body 1 has a number of slots 11 disposed longitudinally around the main body 1, a first clamping section 12 and a second clamping section 13 at the upper portion thereof. The top edge of the first clamping section 12 and the bottom edge of the second clamping section 13 are formed with a first inclined surface 14 and a second inclined surface 15, respectively.

The tightening ring 2 is sleeved onto the first clamping section 12. The top inner edge of the tightening ring 2 is formed with a third inclined surface 21 to be engaged with the first inclined surface 14 of the first clamping section 12. The bottom outer edge of the tightening ring 2 is formed with a fourth inclined surface 22.

The retaining ring 3 is sleeved onto the second clamping section 13. The retaining ring 3 has a fifth inclined surface 31 and a sixth inclined surface 32 formed on the top and bottom inner edges, respectively. The fifth inclined surface 31 is to be engaged with the fourth inclined surface 22 of the tightening ring 2, while the sixth inclined surface 32 is to be engaged with the second inclined surface 15 of the second clamping section 13. The retaining ring 3 is provided with a quick-release rod 33 and a nut 34 to adjust its tightness.

Figure 3:
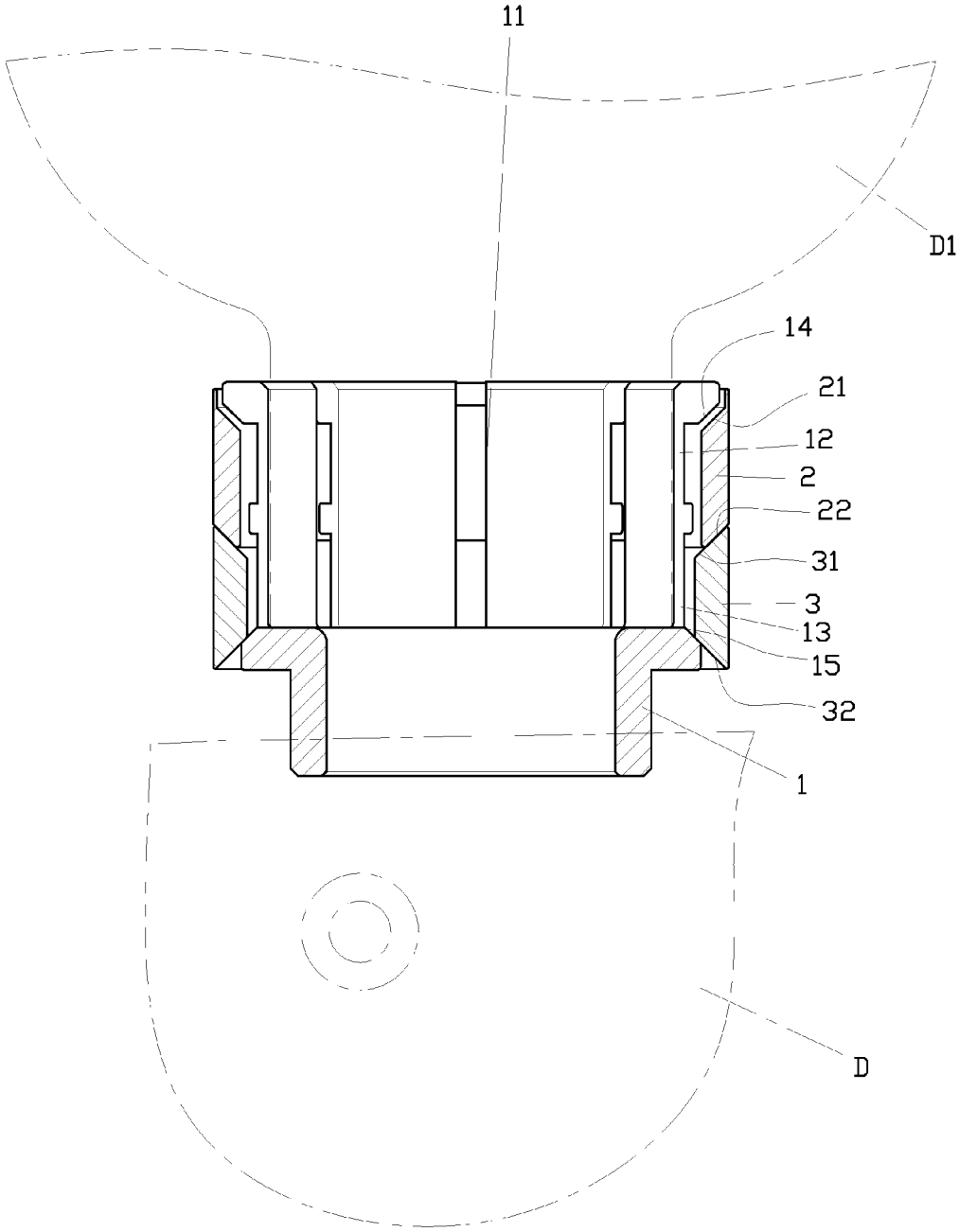
FIG. 3 is a side cross-sectional view of the present invention incorporated with a paint ball gun.
Figure 4:
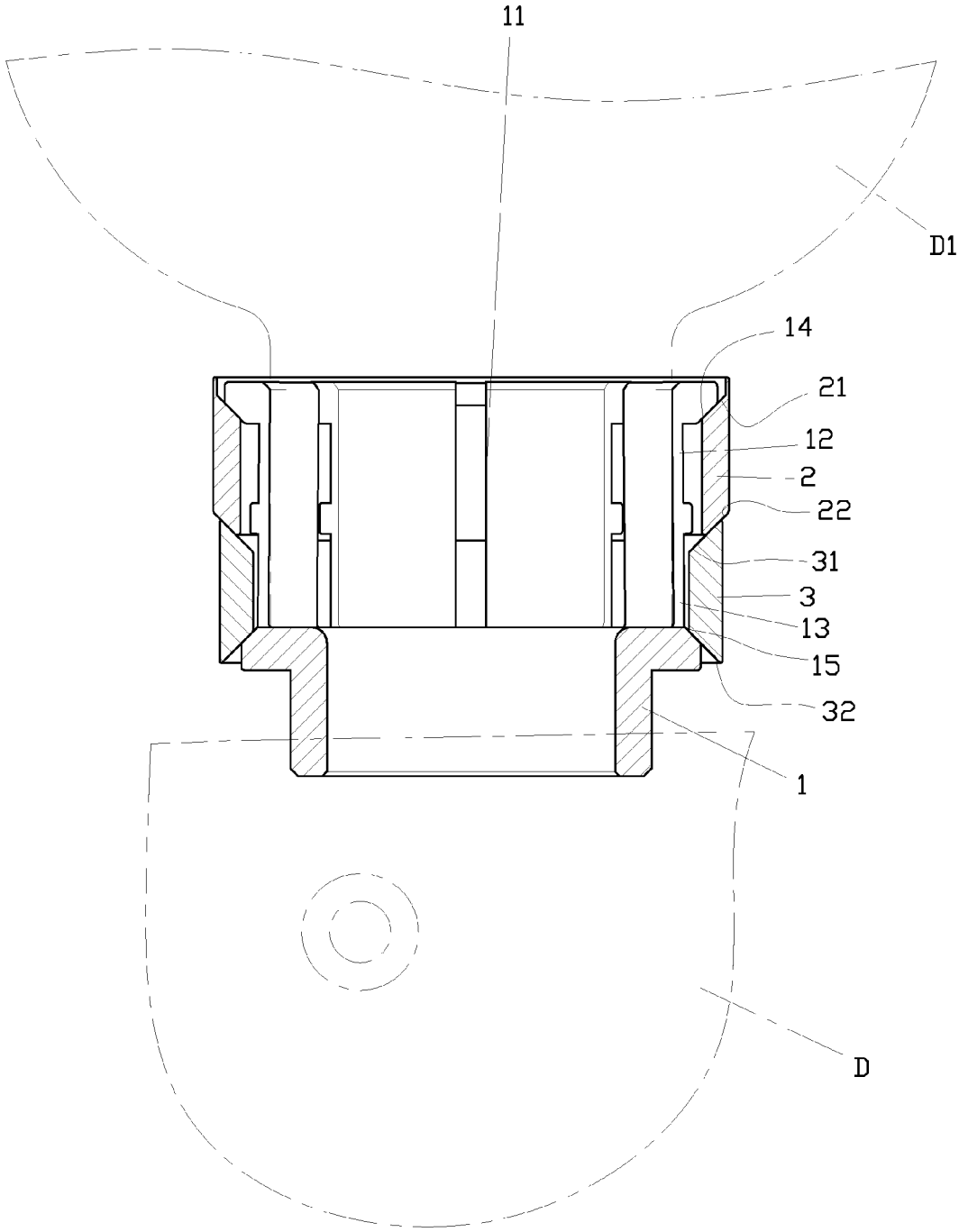
FIG. 4 is a side cross-sectional view of the present invention in an operating status.
Figure 5:
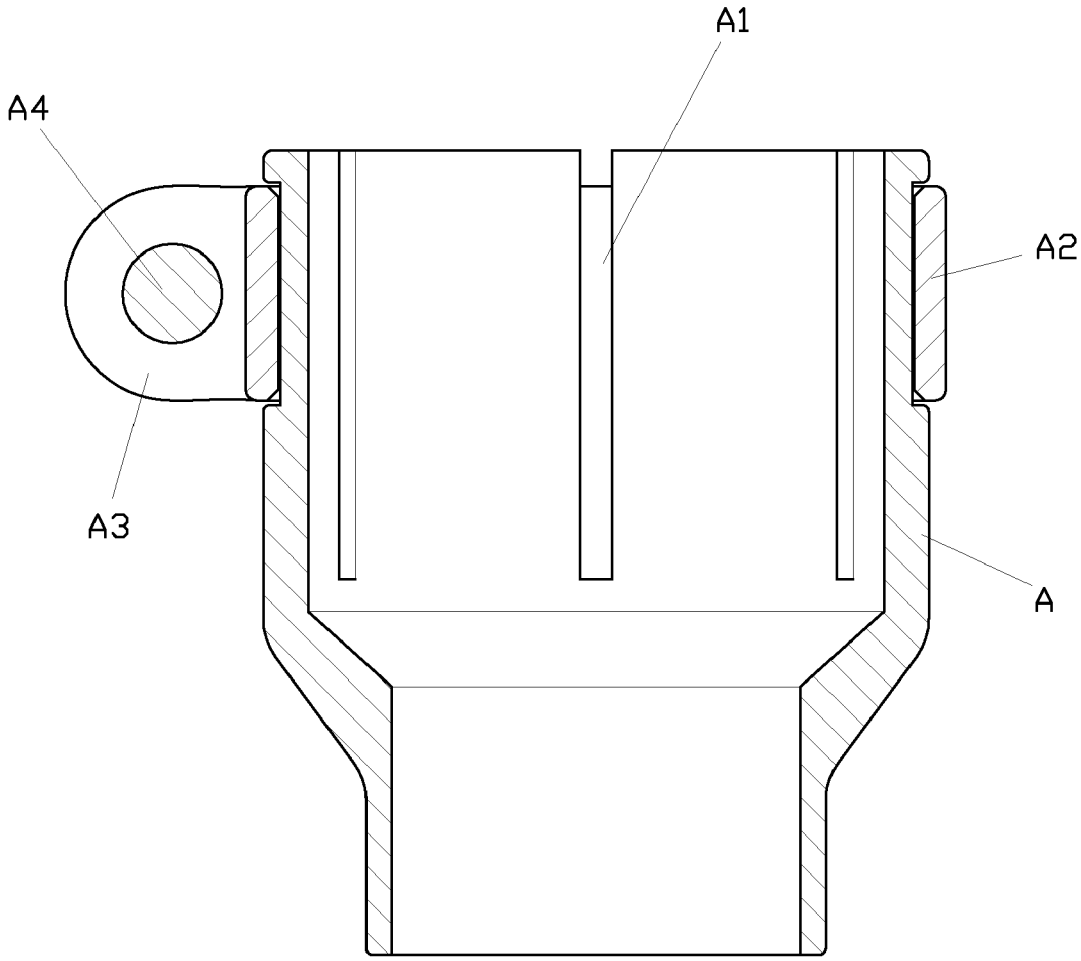
F I G . 5 (PRIOR ART)
FIG. 5 is a cross-sectional view of a first prior art.
Figure 6:
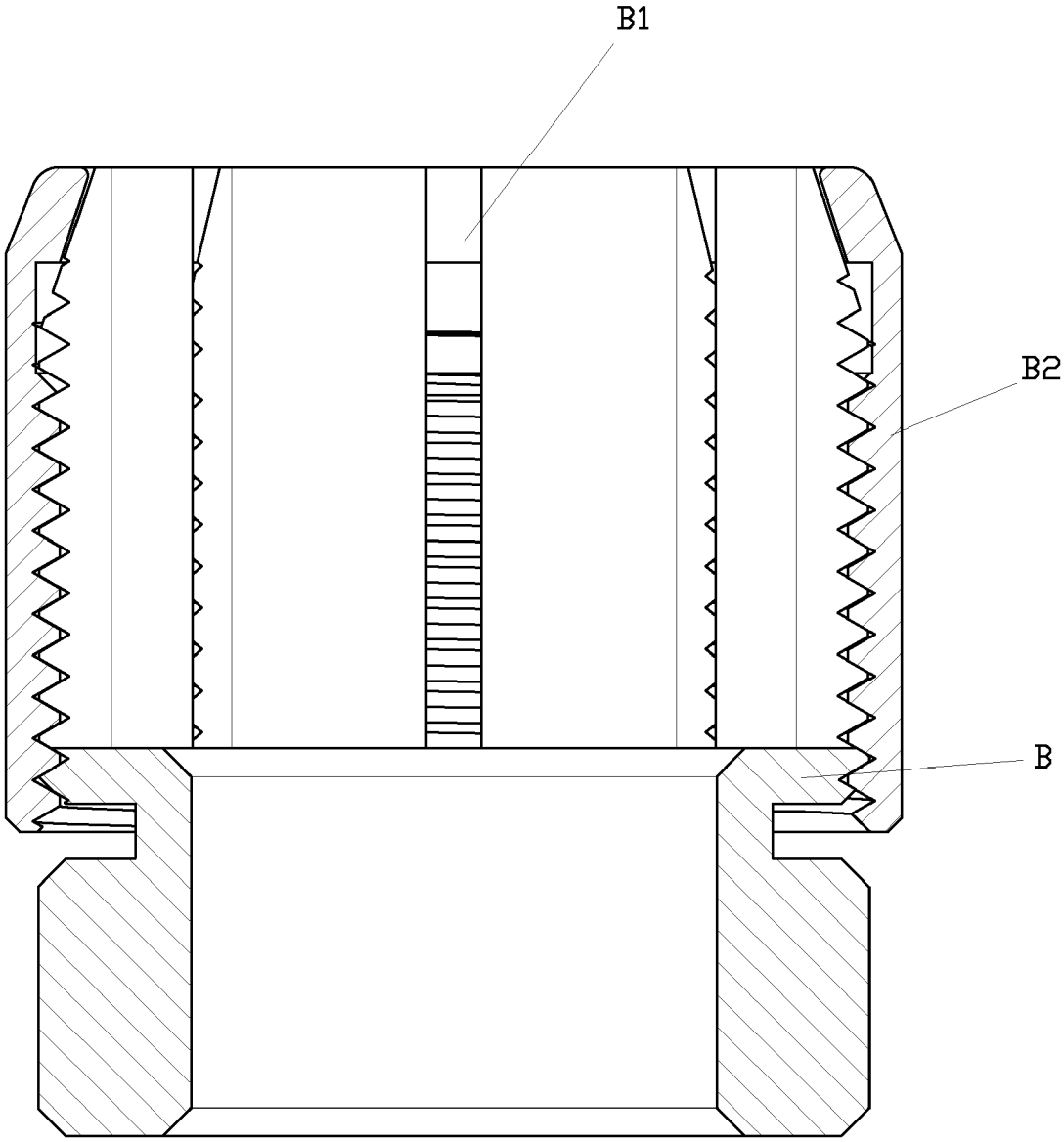
F I G . 6 (PRIOR ART)
FIG. 6 is a cross-sectional view of a second prior art.
Figure 7:
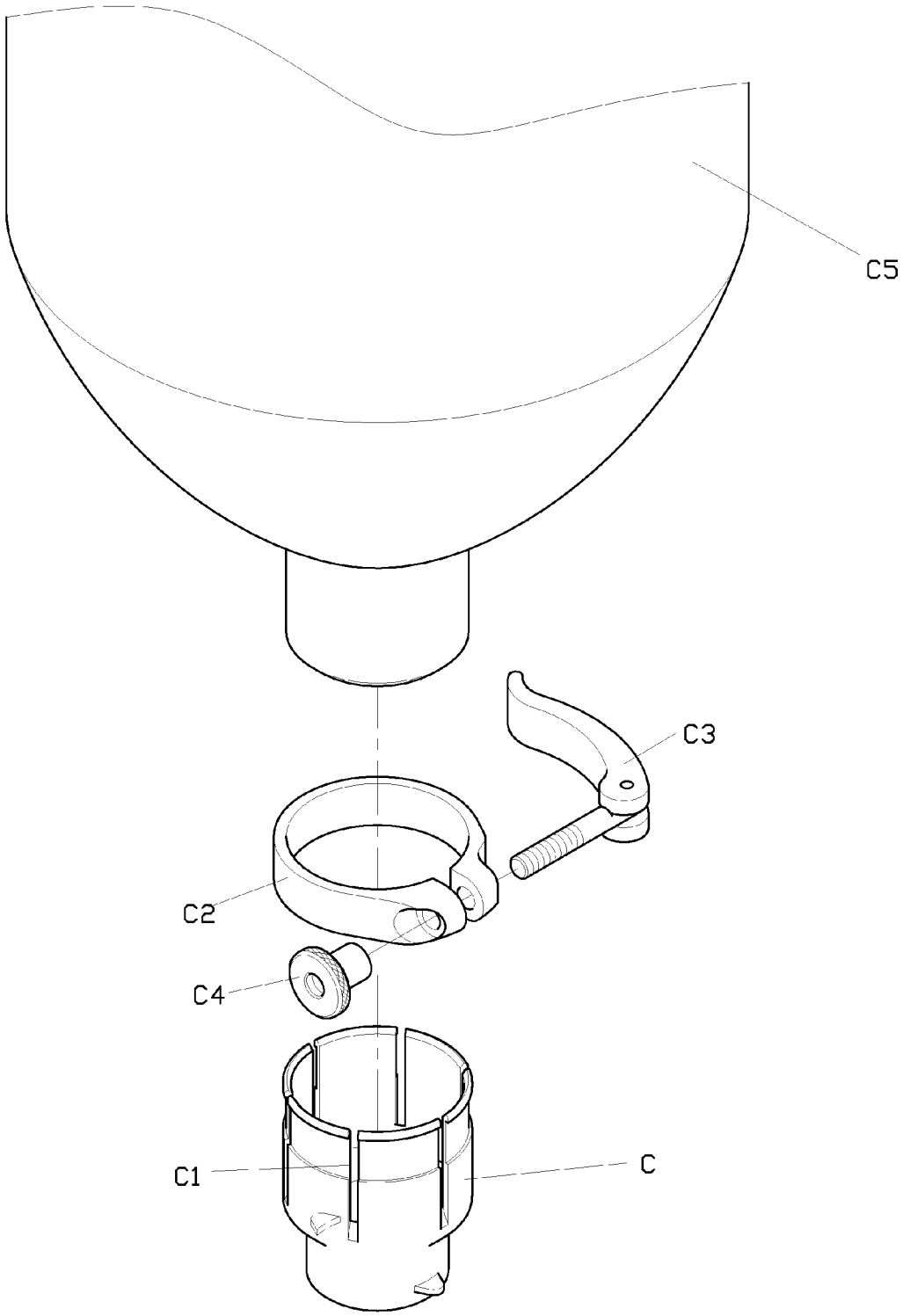
F I G . 7 (PRIOR ART)
FIG. 7 is a perspective view of a third prior art.

To operate the present invention, as shown in FIG. 3, the main body 1 is secured on a paintball gun D, and then a funnel D1 is inserted into the main body 1. By tightening the quick-release rod 33 to adjust the tightness of the second clamping section 13, the fifth inclined surface 31 of the retaining ring 3 and the fourth inclined surface 22 of the tightening ring 2 are engaged with each other. When the retaining ring 3 is tightened inwardly, the fifth inclined surface 31 will push the fourth inclined surface 22 upwardly, which links the tightening ring 2 to move with respect to the first clamping section 12 upwardly. When the tightening ring 2 moves upwardly, the third inclined surface 21 forces the first inclined surface 14 of the first clamping section 12 of the main body 1 to compress inwardly so as to tighten the funnel D1 securely. This tightness of the retaining ring 3 does not apply to the main body 1 direct, thus there is no deformation concern of the main body 1, and the funnel D1 will not be loosened.

Thus, specific embodiments and applications of paintball gun loading device have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprise" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A paintball gun loading device, comprising:

a main body, said main body having a number of slots disposed longitudinally around said main body, a first clamping section and a second clamping section, said first clamping section comprising a first inclined surface and said second clamping section comprising a second inclined surface;

a tightening ring, said tightening ring being sleeved onto said main body and comprising a third inclined surface and a fourth inclined surface, said third inclined surface being engaged with said first inclined surface of said first clamping section; and a retaining ring, said retaining ring being sleeved onto said main body and comprising a fifth inclined surface and a sixth inclined surface, said retaining ring being provided with a quick-release rod and a nut, said fifth inclined surface being engaged with said fourth inclined surface of said tightening ring, said sixth inclined surface being engaged with said second inclined surface of said second clamping section.

2. The paintball gun loading device, as recited in claim 1, wherein said tightening ring is sleeved onto said first clamping section of said main body.

3. The paintball gun loading device, as recited in claim 1, wherein said retaining ring is sleeved onto said second clamping section of said main body.

4. The paintball gun loading device, as recited in claim 1, wherein said first inclined surface is formed on a top edge of said first clamping section.

5. The paintball gun loading device, as recited in claim 1, wherein said second inclined surface is formed on a bottom edge of said second clamping section.

6. The paintball gun loading device, as recited in claim 1, wherein said third inclined surface is formed on a top inner edge of said tightening ring.

7. The paintball gun loading device, as recited in claim 1, wherein said fourth inclined surface is formed on a bottom outer edge of said tightening ring.

8. The paintball gun loading device, as recited in claim 1, wherein said fifth inclined surface is formed on a top inner edge of the retaining ring.

9. The paintball gun loading device, as recited in claim 1, wherein said sixth inclined surface is formed on a bottom inner edge of the retaining ring.

* * * * *